US006293107B1

(12) United States Patent
Kitagawa et al.

(10) Patent No.: US 6,293,107 B1
(45) Date of Patent: Sep. 25, 2001

(54) THERMOELECTRIC COOLING SYSTEM

(75) Inventors: Hiroaki Kitagawa, Otsu; Munekazu Maeda, Yao; Osamu Nakagawa, Kouka-gun; Shigetomi Tokunaga, Otsu, all of (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/297,683

(22) PCT Filed: Nov. 7, 1997

(86) PCT No.: PCT/JP97/04062

§ 371 Date: May 6, 1999

§ 102(e) Date: May 6, 1999

(87) PCT Pub. No.: WO98/21531

PCT Pub. Date: May 22, 1998

(30) Foreign Application Priority Data

Nov. 8, 1996 (JP) ..... 8-296269

(51) Int. Cl.[7] ..... F25B 21/02
(52) U.S. Cl. ..... 62/3.6; 62/3.2
(58) Field of Search ..... 62/3.6, 3.2, 3.7

(56) References Cited

U.S. PATENT DOCUMENTS 4,829,771 * 5/1989 Koslow et al. ..... 62/3.641
5,154,661 * 10/1992 Higgins ..... 62/3.3
5,269,146 * 12/1993 Kerner ..... 62/3.6
5,544,487 * 8/1996 Attey et al. ..... 62/3.7
5,782,106 * 7/1998 Park ..... 62/452
5,890,371 * 4/1999 Rajasubramanian et al. ..... 62/259.2
6,038,865 * 3/2000 Watanabe et al. ..... 62/3.6

FOREIGN PATENT DOCUMENTS 6-504361 5/1994 (JP) .
7-12421 1/1995 (JP) .
7-234036 9/1995 (JP) .
92/13243 8/1992 (WO) .

* cited by examiner

*Primary Examiner*—William Doerrler
*Assistant Examiner*—Melvin Jones
(74) *Attorney, Agent, or Firm*—Wenderoth, Lind & Ponack, L.L.P.

(57) ABSTRACT

Air traps 37*a*, 37*b* are disposed on one side adjacent at least one of suction and discharge ports of circulating pumps 14*a*, 14*b* forming a heat radiating or heat absorbing cycle. Also, the circulating pumps 14*a*, 14*b* are disposed at a level higher than heat-radiating and cooling heat exchangers 10, 20 and first and second heat exchanging portions 26*a*, 26*b* to recover air bubbles mixed therein so that the air bubbles circulated can be reduced to improve the heat efficiency.

33 Claims, 11 Drawing Sheets

THERMOELECTRIC COOLING SYSTEM

FIELD OF THE INVENTION

The present invention relates to a thermoelectric refrigeration system in, for example, an electric refrigerator of a type utilizing a Peltier element to refrigerate the interior of a refrigerator cabinet.

BACKGROUND ART

A technique of use of the Peltier element in a refrigeration system is disclosed in a PCT Japanese patent publication No. 6-504361. According to this known technique, the Peltier element has a heat radiating surface and a cooling surface each thermally coupled with a coolant passage through which a liquid coolant is forcibly circulated. By so doing, an object can be cooled by a heat exchanger disposed on the coolant passage thermally coupled with the cooling surface of the Peltier element, or can be heated by a heat exchanger disposed on the coolant passage thermally coupled with the heat radiating surface of the Peltier element.

However, in order to realize an electric refrigerator by the use of the above discussed technique, problems have been encountered to further increase the heat efficiency and also to avoid inclusion of air bubbles in the liquid coolant that is filled in the coolant passages.

Also, as far as the interior of the refrigerator is concerned, both an ice chamber and a food storage chamber for accommodating food materials have to be refrigerated efficiently.

In addition, condensation that results in formation of condensed liquid droplets around tubings used in the coolant passages must be minimized.

The present invention has been developed in view of the above discussed problems inherent in the prior art technique and is intended to provide a thermoelectric refrigeration system effective to minimize the inclusion of the air bubbles which would recirculate within the coolant passages.

Another object of the present invention is to provide a thermoelectric refrigeration system effective to minimize the condensation which would result in formation of condensed liquid droplets around the tubings of the coolant passages.

A further object of the present invention is to provide a thermoelectric refrigeration system of an increased heat efficiency which has a high safety factor and wherein piping can easily be accomplished.

DISCLOSURE OF THE INVENTION

In order to accomplish the above objects, a thermoelectric refrigeration system of the present invention comprises a thermoelectric module having a heat radiating surface and a cooling surface; a first heat exchanging portion thermally coupled with the heat radiating surface of the thermoelectric module; a second heat exchanging portion thermally coupled with the cooling surface of the thermoelectric module; a heat radiating system comprising a circulating passage which includes a circulating pump having a discharge port and a suction port, a heat-radiating heat exchanger, the first heat exchanging portion, and a liquid medium filled in the circulating passage; and an air trap coupled with at least one of the suction and discharge ports of the circulating pump.

Preferably, the circulating pump is positioned at a level higher than the level where the heat-radiating heat exchanger and the first heat exchanging portion are disposed.

A thermoelectric refrigeration system according to another aspect of the present invention comprises a thermoelectric module having a heat radiating surface and a cooling surface; a first heat exchanging portion thermally coupled with the heat radiating surface of the thermoelectric module; a second heat exchanging portion thermally coupled with the cooling surface of the thermoelectric module; a heat absorbing system comprising a circulating passage which includes a circulating pump having a discharge port and a suction port, a cooling heat exchanger, the second heat exchanging portion, and a liquid medium filled in the circulating passage; and an air trap coupled with at least one of the suction and discharge ports of the circulating pump.

Preferably, the circulating pump is positioned at a level higher than the level where the cooling heat exchanger and the second heat exchanging portion are disposed.

A thermoelectric refrigeration system according to a further aspect of the present invention comprises a thermoelectric module having a heat radiating surface and a cooling surface; a manifold including a first heat exchanging portion thermally coupled with the heat radiating surface of the thermoelectric module, and a second heat exchanging portion thermally coupled with the cooling surface of the thermoelectric module; a heat radiating system comprising a first circulating passage which includes a first circulating pump having a discharge port and a suction port, a heat-radiating heat exchanger, the first heat exchanging portion of the manifold, and a liquid medium filled in the first circulating passage; a heat absorbing system comprising a second circulating passage which includes a second circulating pump having a discharge port and a suction port, a cooling heat exchanger, the second heat exchanging portion of the manifold, and a liquid medium filled in the second circulating passage; and an air trap coupled with at least one of the suction and discharge ports of any one of the first and second circulating pumps.

A thermoelectric refrigeration system according to a still further aspect of the present invention comprises first and second thermoelectric modules each having a heat radiating surface and a cooling surface; a primary manifold including a first heat exchanging portion thermally coupled with the heat radiating surface of the first thermoelectric module, and a second heat exchanging portion thermally coupled with the cooling surface of the first thermoelectric module; an auxiliary manifold including a third heat exchanging portion thermally coupled with the heat radiating surface of the second thermoelectric module; a heat radiating system comprising a first circulating passage which includes a first circulating pump having a discharge port and a suction port, a heat-radiating heat exchanger, the first heat exchanging portion of the primary manifold, and a liquid medium filled in the first circulating passage; a heat absorbing system comprising a second circulating passage which includes a second circulating pump having a discharge port and a suction port, a cooling heat exchanger, the third heat exchanging portion of the auxiliary manifold, and a liquid medium filled in the second circulating passage; and an air trap coupled with at least one of the suction and discharge ports of any one of the first and second circulating pumps.

Preferably, the first circulating pump is positioned at a level higher than the level where the heat-radiating heat exchanger and the first heat exchanging portion are disposed, and the second circulating pump is positioned at a level higher than the level where the cooling heat exchanger and the second heat exchanging portion are disposed.

According to the foregoing structure, air bubbles flowing within the circulating passage can be recovered by the air trap and, therefore, the air bubbles within the circulating passage can efficiently be removed.

Where the thermoelectric refrigeration system of the present invention is to be applied to an electric refrigerator, the second circulating pump and the manifold have to be positioned inside and outside a refrigerator cabinet, respectively, and a piping fluid-coupled at one end with the discharge port of the second circulating pump has to extend within the refrigerator cabinet with the opposite end thereof drawn outside the refrigerator cabinet at a location adjacent the manifold. In this application, a substantial length of the piping can be disposed within the refrigerator cabinet with no possibility of contacting the warm air drifting outside the refrigerator cabinet and, therefore, the condensation can advantageously be minimized.

Also, the heat efficiency can be increased if the liquid medium within the first heat exchanging portion and the liquid medium within the second heat exchanging portion are allowed to flow in respective directions counter to each other.

If connecting pipes used in the circulating passages are employed in the form of a soft tube, the piping can be accomplished easily.

If the liquid medium referred to above is employed in the form of a mixture of water and propylene glycol, leakage of the liquid medium if in a small quantity would pose no toxic problem to the safety of the user.

BEST MODE FOR CARRYING OUT THE INVENTION

Hereinafter, the thermoelectric refrigeration system of the present invention will be described as applied to an electric refrigerator.

(Embodiment 1)

FIGS. 1 to 10 illustrate the first preferred embodiment of the present invention.

Figure 1:
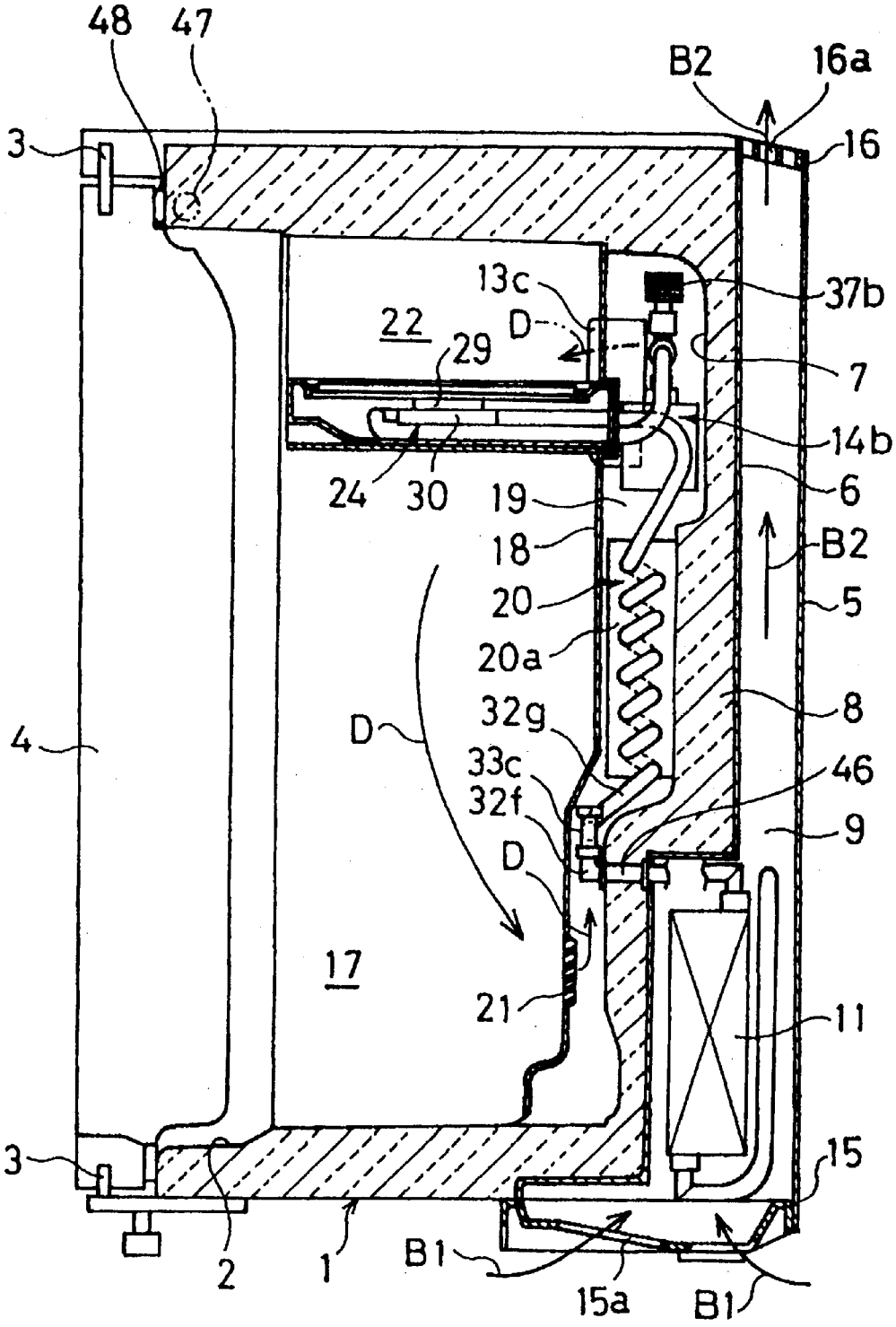
FIG. 1 is a longitudinal sectional view of an electric refrigerator employing a thermoelectric refrigeration system according to a first preferred embodiment of the present invention.
Figure 2:
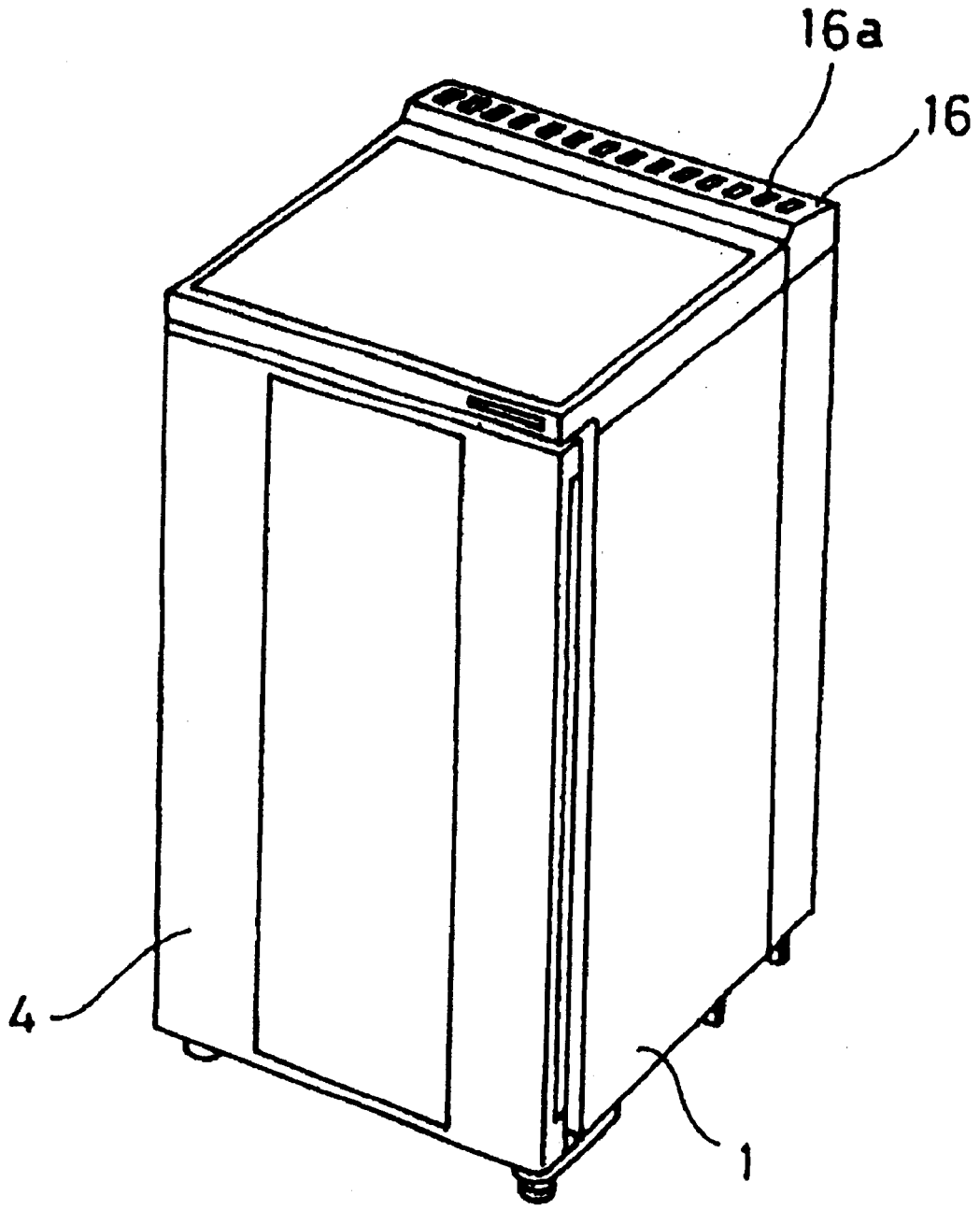
FIG. 2 is a perspective view of the electric refrigerator shown in FIG. 1.

As shown in FIGS. 1 and 2, an electric refrigerator comprises a refrigerator cabinet 1 having a front opening 2 defined therein, and a front door 4 hingedly supported by a shaft 3 for selectively opening and closing the front opening 2. The refrigerator cabinet 1 includes a rear wall 5 closing a rear opening thereof, a partition wall 6 positioned inside and secured to the refrigerator cabinet 1 while spaced a distance inwardly from the rear wall 5, and a chamber defining structure 7 positioned inside the refrigerator cabinet 1, with an insulating material 8 packed in a space between the partition wall 6 and the chamber defining structure 7.

Figure 3:
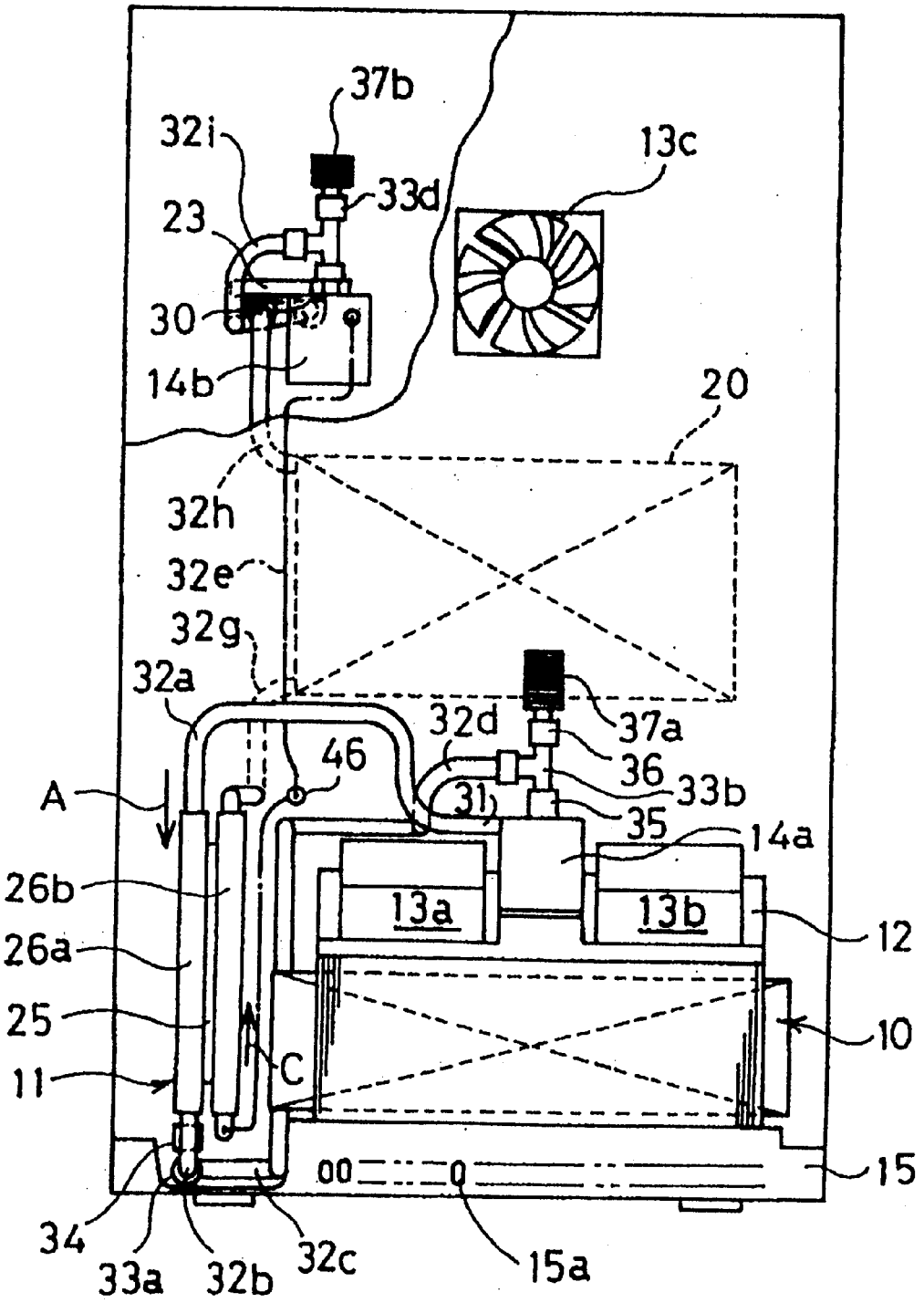
FIG. 3 is a rear view, with a portion cut out, of the electric refrigerator shown in FIG. 1.
Figure 4:
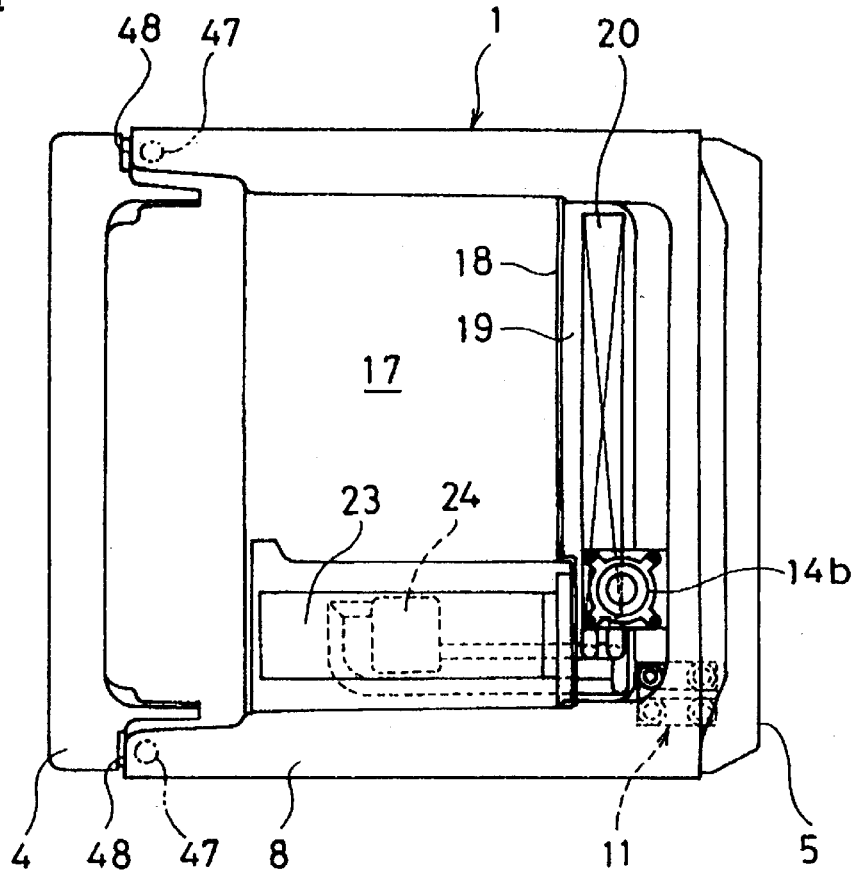
FIG. 4 is a transverse sectional view of an upper portion of the electric refrigerator shown in FIG. 1.
Figure 5:
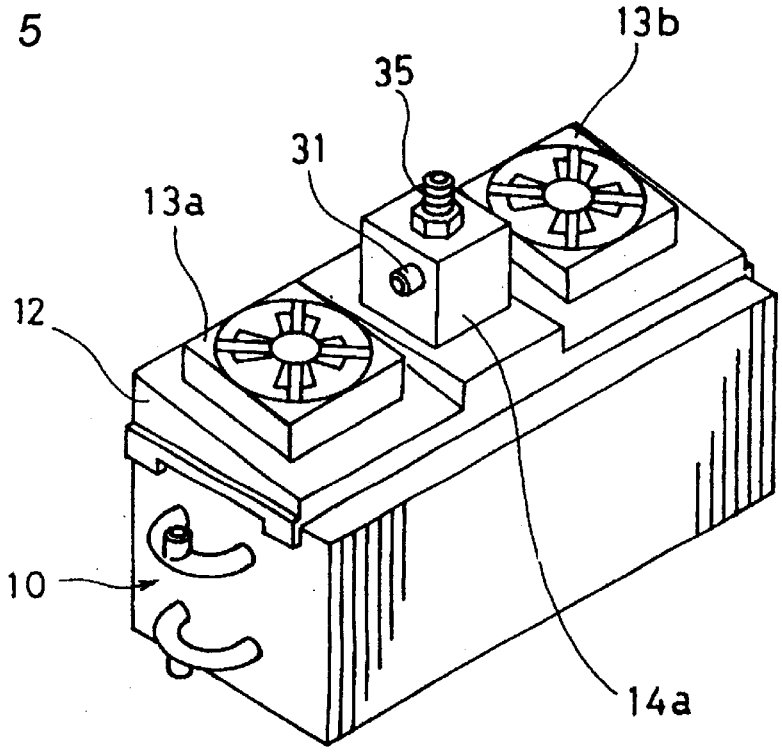
FIG. 5 is a perspective view showing a heat-radiating heat exchanger and a circulating pump employed in the electric refrigerator shown in FIG. 1.

As shown in FIGS. 1, 3 and 4, an outdoor chamber 9 defined between the rear wall 5 and the partition wall 6 accommodates therein a heat-radiating heat exchanger 10, positioned at a lower region of the outdoor chamber 9, and a primary manifold 11 as will be described later. Fan drive motors 13*a* and 13*b* are mounted atop the heat-radiating heat exchanger 10 through a hood 12 as shown in FIG. 5. A first circulating pump 14*a* is mounted on an upper face of the hood 12 and between the fan drive motors 13*a* and 13*b*.

A lower grille 15 having suction openings 15*a* defined therein is fitted to the bottom of the outdoor chamber 9, and an upper grille 16 having discharge openings 16*a* defined therein is fitted to the top of the outdoor chamber 9. Air drawn into the outdoor chamber 9 through the suction openings 15*a* in the lower grille 15 when the fan drive motors 13*a* and 13*b* are driven flows through fins of the heat-radiating heat exchanger 10 and is then discharged to the outside through the discharge openings 16*a* in the upper grille 16.

An indoor chamber 17 defined inside the chamber defining structure 7 has a partition wall 18 installed inside the chamber defining structure 7 so as to define a machine chamber 19 in which a cooling heat exchanger 20 and a second circulating pump 14*b* positioned above the cooling heat exchanger 20 are accommodated. A fan drive motor 13*c* is mounted atop the partition wall 18, and suction ports 21 are defined in a lower region of the partition wall 18. Air inside the indoor chamber 17 is, when the fan drive motor 13*c* is driven, drawn into the machine chamber 19 through the suction openings 21 in the partition wall 18 and is, after having passed through fins 20*a* of the cooling heat exchanger 20, circulated by the fan drive motor 13*c* back into the indoor chamber 17.

As shown in FIGS. 1 and 4, an upper portion of the indoor chamber 17 defines an ice chamber 22 including an ice making plate 23, and an auxiliary manifold 24 as will be described later is fitted to a rear portion of the ice making plate 23.

Figure 6:
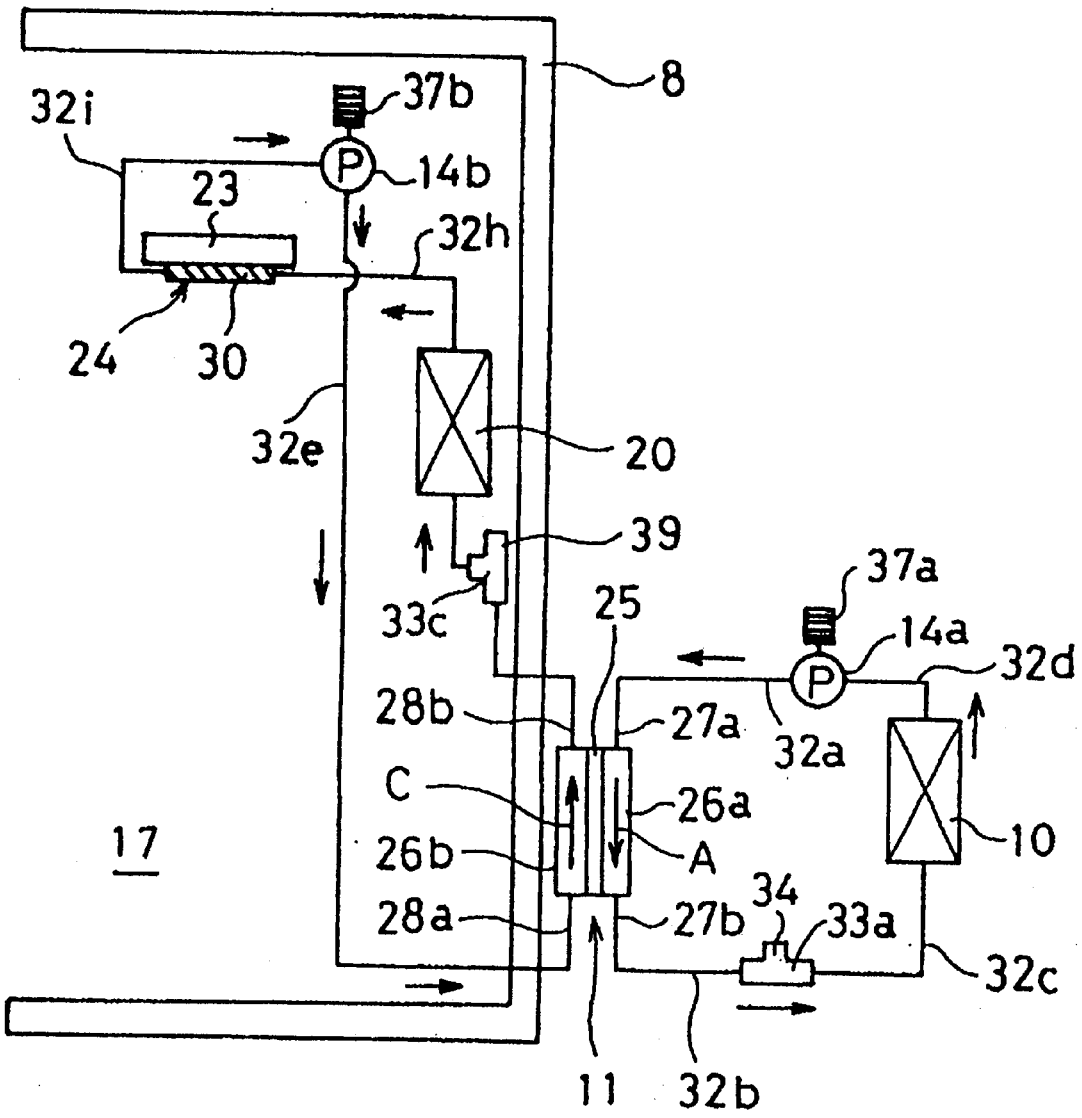
FIG. 6 is a schematic diagram showing a piping system for heat radiating and heat absorbing cycles in the electric refrigerator shown in FIG. 1.

The primary manifold 11 referred to above includes, as shown in FIG. 6, a Peltier element 25 as a thermoelectric module, a first heat exchanging portion 26*a* thermally coupled with a heat radiating surface of the Peltier element 25, and a second heat exchanging portion 26*b* thermally coupled with a cooling surface of the Peltier element 25. When a liquid coolant is supplied from one end 27*a* of the first heat exchanging portion 26*a*, the liquid coolant can absorb heat radiating from the heat radiating surface of the Peltier element 25, accompanied by an increase in temperature of the liquid coolant which is subsequently flows outwardly from the opposite end 27*b* of the first heat exchanging portion 26*a*. When a liquid coolant is supplied from one end 28*a* of the second heat exchanging portion 26*b*, heat can be transmitted to the cooling surface of the Peltier element 25, resulting in decrease of the temperature of the liquid coolant which subsequently flows outwardly from the opposite end 28*b* of the second heat exchanging portion 26*b*.

The auxiliary manifold 24 is similar to the primary manifold and includes a Peltier element 29 as a thermoelectric module, and a third heat exchanging portion 30 thermally coupled with a heat radiating surface of the Peltier element 29. The ice making plate 23 referred to previously is held in contact with and is therefore thermally coupled with a cooling surface of this Peltier element 29.

Figure 7:
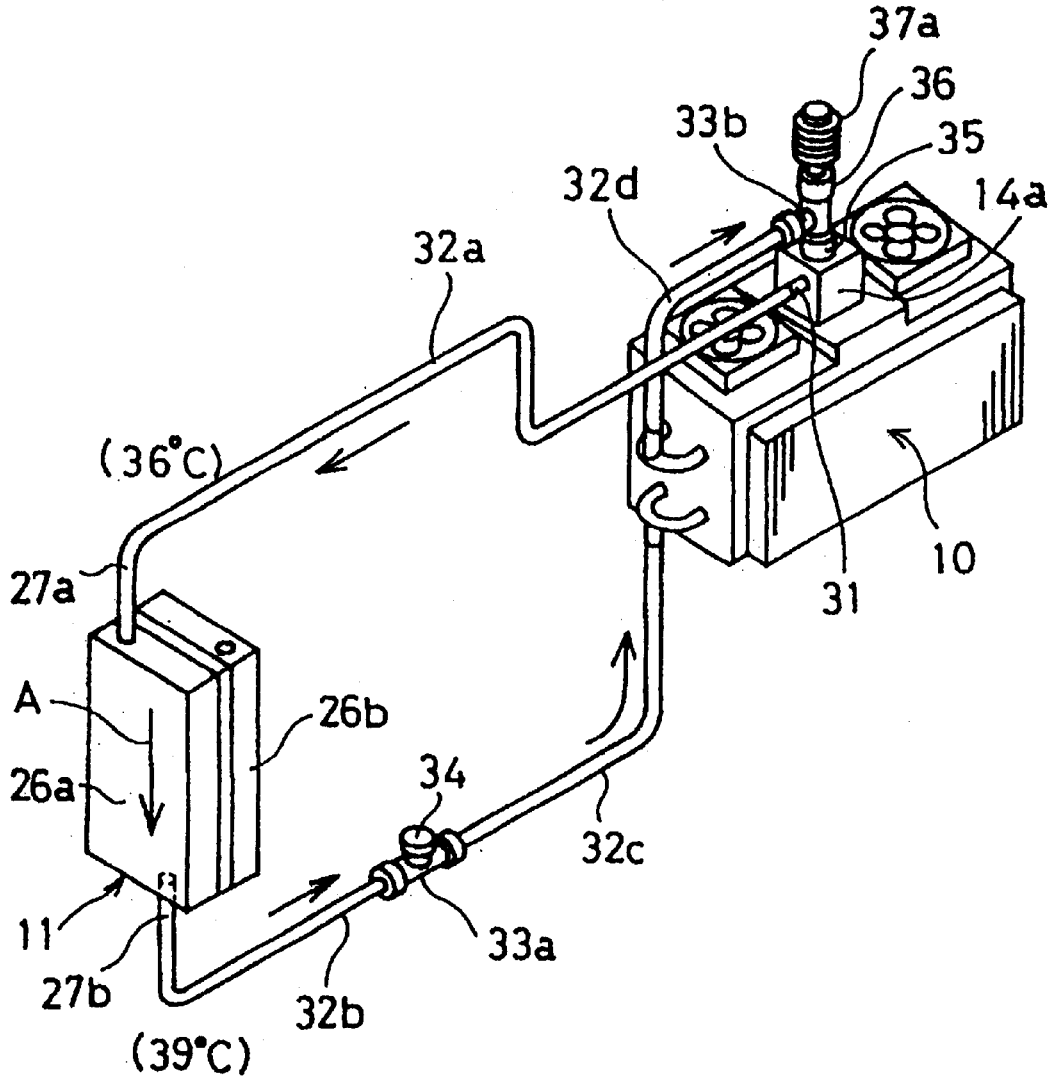
FIG. 7 is a perspective view showing component parts forming the heat radiating cycle.

A first circulating passage of a heat radiating system for circulating the liquid coolant from the first circulating pump 14*a* back to the first circulating pump 14*a* via the heat-radiating heat exchanger 10 and the first heat exchanging portion 26*a* of the primary manifold 11 is so designed as shown in FIG. 7.

The first circulating pump 14*a* has a discharge port 31 fluid-connected with the end 27*a* of the first heat exchanging portion 26*a* of the primary manifold 11 through a first piping 32*a,* and the other end 27*b* of the first heat exchanging portion 26*a* of the primary manifold 11 and one end of the heat-radiating heat exchanger 10 are fluid-connected with each other through second and third pipings 32*b* and 32*c* with a generally T-shaped fluid coupler 33*a* interposed therebetween. A remaining coupling port 34 of the T-shaped fluid coupler 33*a* is finally closed by a cap.

Figure 9:
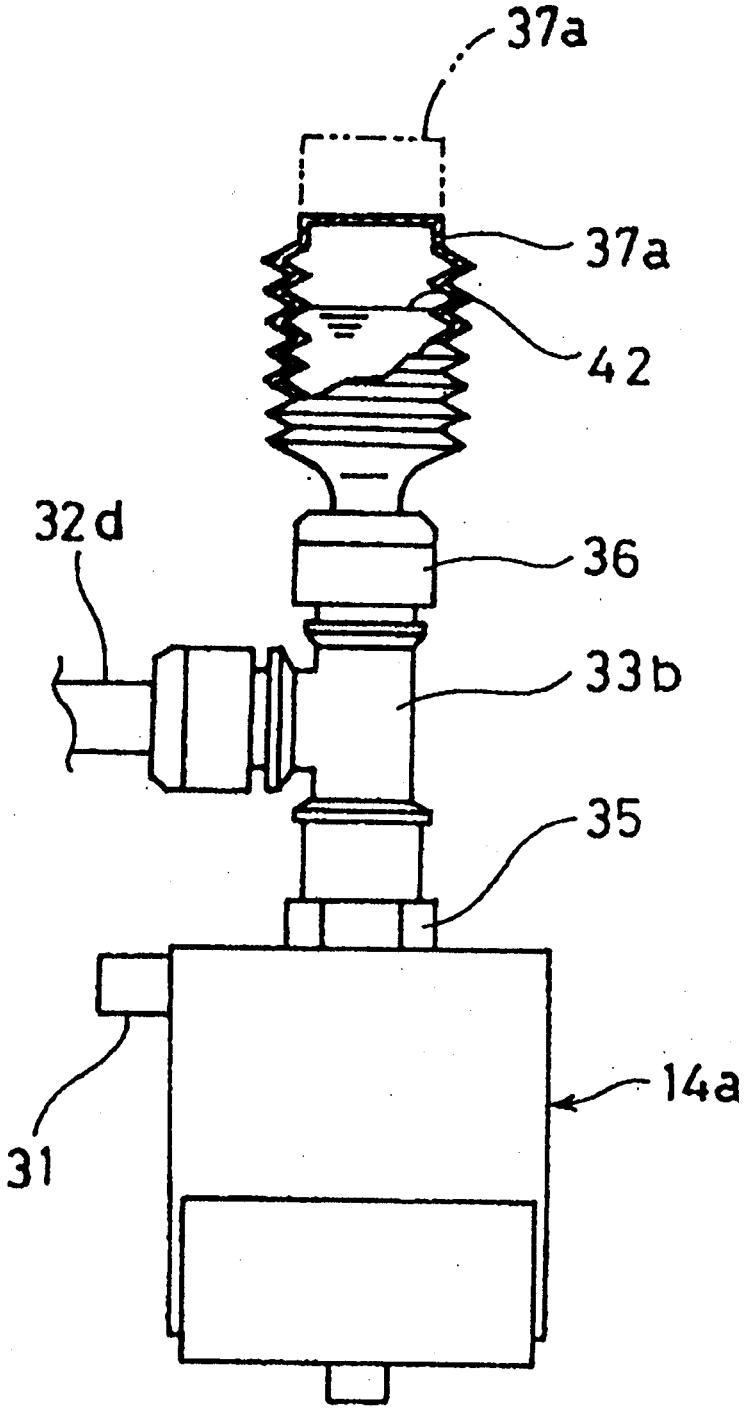
FIG. 9 is a side view showing the manner in which an air trap is fitted to the circulating pump.

The opposite end of the heat-radiating heat exchanger 10 and a suction port 35 of the first circulating pump 14*a* are fluid-connected together through a fourth piping 32*d* and a generally T-shaped fluid coupler 33*b*. A remaining coupling port 36 of the T-shaped fluid coupler 33*b* is finally fitted with a first air trap 37*a* expandable between a solid-lined position and a phantom-lined position as shown in FIG. 9.

Figure 8:
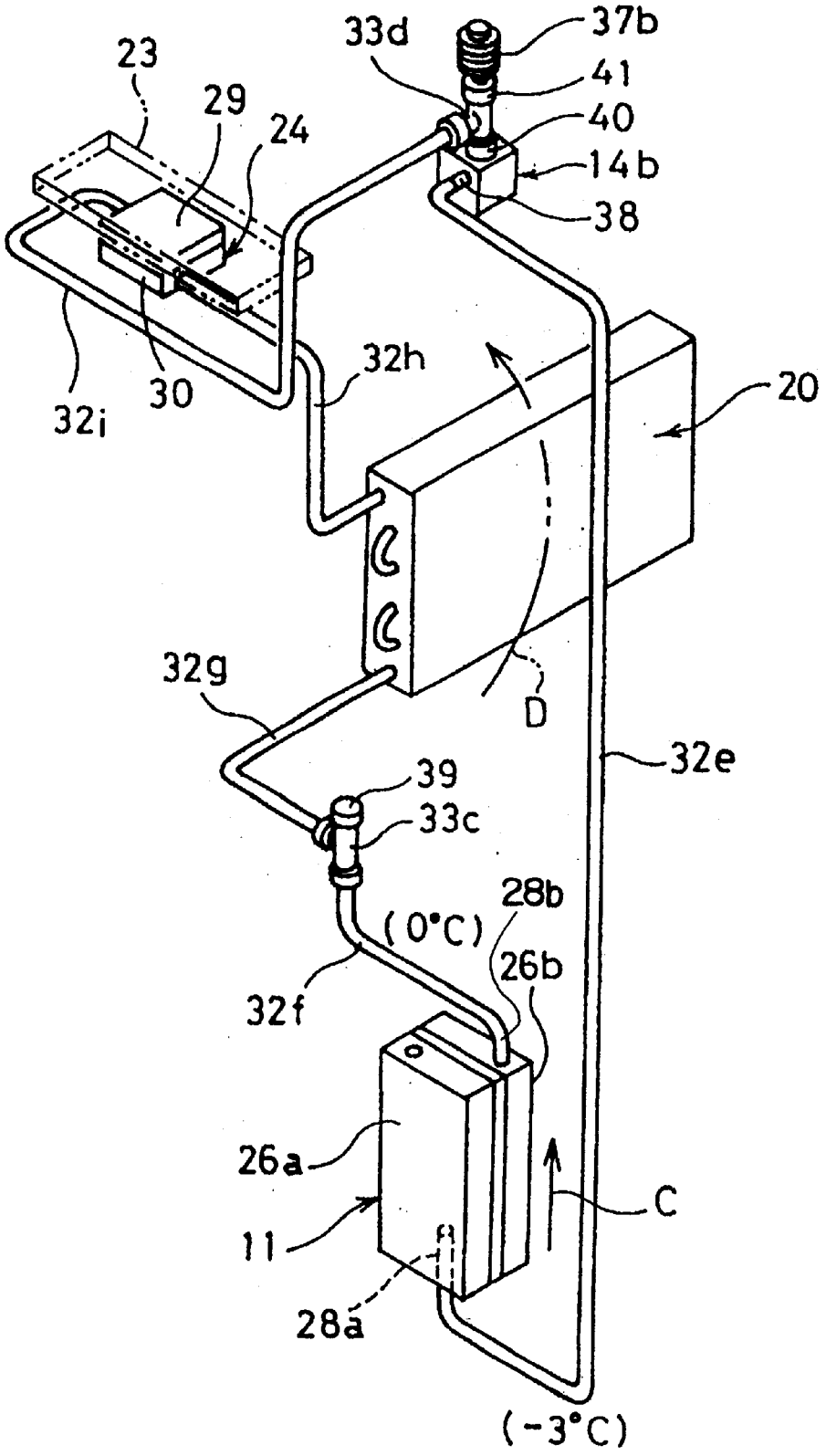
FIG. 8 is a perspective view showing component parts forming the heat absorbing cycle.

A second circulating passage of the heat absorbing system for circulating the liquid coolant from the second circulating pump 14*b* back to the second circulating pump 14*b* via the cooling heat exchanger 20 and the second heat exchanging portion 26*b* of the primary manifold 11 is so designed as shown in FIG. 8.

The second circulating pump 14*b* has a discharge port 38 fluid-connected with one end 28*a* of the second heat exchanging portion 26*b* of the primary manifold 11 through a fifth piping 32*e*, and the other end 28*b* of the second heat exchanging portion 26*b* of the primary manifold 11 and one end of the cooling heat exchanger 20 are fluid-connected with each other through sixth and seventh pipings 32*f* and 32*g* with a generally T-shaped fluid coupler 33*c* interposed therebetween. A remaining coupling port 39 of the T-shaped fluid coupler 33*c* is finally closed by a cap.

The opposite end of the cooling heat exchanger 20 and one end of the third heat exchanging portion 30 of the auxiliary manifold 24 are fluid-connected together through an eighth piping 32*h*, and the opposite end of the third heat exchanging portion 30 of the auxiliary manifold 24 and a suction port 40 of the second circulating pump 14*b* are fluid-connected together through a ninth piping 32*i* and a generally T-shaped fluid coupler 33*d* interposed therebetween. A remaining coupling port 41 of the T-shaped fluid coupler 33*d* is finally fitted with a second air trap 37*b* similar to the first air trap 37*a*.

It is to be noted that although not shown, the primary manifold 11 is in practice covered with a heat insulating material.

For each of the pipings 32*a* to 32*i*, a soft tube made of, for example, butyl chloride rubber may be employed to make it easy to install the pipings.

Thus, by designing the first and second circulating passages in the manner described above, filling the liquid coolant, which is a mixture of propylene glycol and water, initiating supply of an electric power to the Peltier elements 25 and 29 of the primary and auxiliary manifolds 11 and 24, driving the first and second circulating pumps 14*a* and 14*b*, and driving the fan drive motors 13*a*, 13*b* and 13*c*, the liquid coolant flowing downwardly through the first heat exchanging portion 26*a* of the primary manifold 11 as shown by the arrow A in FIGS. 3 and 7 is heated by heat generated from the heat radiating surface of the Peltier element 25, and the heated liquid coolant dissipates heat during the flow through the heat-radiating heat exchanger 10, accompanied by reduction in temperature and, is thereafter, returned back to the first heat exchanging portion 26*a* of the primary manifold 11 to thereby complete a heat radiating cycle during which a stream of air B1 sucked through the lower grille 15 and heat radiated from the heat radiating surface of the Peltier element 25 are heat-exchanged in the heat-radiating heat exchanger 10 to produce a heated stream of air B2 which is then discharged to the atmosphere through the upper grille 16.

Also, the liquid coolant flows upwardly through the second heat exchanging portion 26*b* of the primary manifold 11 as shown by the arrow C in FIGS. 3 and 8 and the liquid coolant which has been cooled in contact with the cooling surface of the Peltier element 29 with a temperature thereof consequently reduced is heat-exchanged during the flow through the cooling heat exchanger 20 with the circulated air D within the indoor chamber 17 to thereby cool the indoor chamber 17, and the liquid coolant during the flow through the third heat exchanging portion 30 of the auxiliary manifold 24 is again heat-exchanged in contact with the heat radiating surface of the Peltier element 29, accompanied by increase in temperature thereof and is then returned to the second heat exchanging portion 26*b* of the primary manifold 11, thereby completing a heat absorbing cycle.

By causing the liquid coolant within the first heat exchanging portion 26*a* of the primary manifold 11 and the liquid coolant within the second heat exchanging portion 26*b* of the primary manifold 11 to flow in respective directions counter to each other, the maximum temperature difference between the heat radiating surface and the heat absorbing surface of the Peltier element 29 can be minimized as compared with the case in which those liquid coolants are allowed to flow in the same direction. Therefore, any possible thermal strain which would act on the Peltier element 29 can be minimized to increase the durability of the Peltier element 29.

Also, the propylene glycol contained in the mixture used as the liquid coolant is less toxic to the human being if the amount of leakage thereof is small, and therefore, it is safe for the user. Also, the proportion of propylene glycol in the mixture is preferably within the range of 15 to 60% when the temperature and the viscosity of the mixture during use thereof are taken into consideration.

The temperature of the heat radiating and heat absorbing cycles discussed above has been found such that when the system was operated to refrigerate the indoor chamber 17 of 60 liters in volume to 5° C. while the outdoor temperature was 30° C., the temperature of the liquid coolant at an inlet side (the end 27*a*) of the first heat exchanging portion 26*a* of the primary manifold 11 was 36° C. and the liquid coolant at an exit side (the opposite end 27*b*) of the first heat exchanging portion 26*a* was 39° C. The temperature of the heat radiating and heat absorbing cycles discussed above has been the second heat exchanging portion 26*b* of the primary manifold 11 was −3° C., the temperature of the liquid coolant at an outlet side (the opposite end 28*b*) of the second heat exchanging portion 26*b* was 0° C., and the temperature of the liquid coolant at an outlet side of the third heat exchanging portion 30 of the auxiliary manifold 24 was +2° C. At this time, the surface of the ice making plate 23 attained −10° C. sufficient to make ice.

In order to realize such a high efficiency as discussed above, in the electric refrigerator of the present invention employing the thermoelectric module, the respective positions where the first and second circulating pumps 14*a* and 14*b* are disposed are properly selected and, at the same time, the first and second air traps 37*a* and 37*b* are employed to avoid air bubbles from being circulated during any of the heat radiating and heat absorbing cycles. As shown in FIGS. 1, 3 and 7–9, the air traps 37*a* and 37*b* are branched upwardly from the first and second circulating passages, respectively, so as to be positioned at respective levels higher than the first and second circulating pumps 14*a* and 14*b*, respectively.

More specifically, the first circulating pump 14*a* used in the heat radiating cycle is, as shown in FIGS. 3 and 7, disposed at a level higher than the heat-radiating heat exchanger 10 and the first heat exchanging portion 26*a* of the primary manifold 11. The air bubbles entering the heat radiating cycle are collected in the vicinity of a suction port 35 of the first circulating pump 14*a* disposed above the heat radiating cycle and are, during the drive of the first circulating pump 14*a*, drawn into the first circulating pump 14*a* through the suction port 35 thereof, gathering at a center portion of a pump impeller within the first circulating pump 14*a* so that the air bubbles discharged from the discharge port 31 of the first circulating pump 14*a* can be reduced, whereby the amount of the air bubbles being circulated in the heat radiating cycle is reduced. It is to be noted that the first air trap 37*a* is contracted to the solid-lined position as shown in FIG. 9 during the drive of the first circulating pump 14*a*.

When the first circulating pump 14*a* is brought to a halt, the air bubbles gathering at the center portion of the pump impeller within the first circulating pump 14*a* float from the suction port 35 to the first air trap 37*a* and are then recovered in the first air trap 37*a*. Reference numeral 42 represents a top surface of the liquid coolant within the first air trap 37*a*.

Also, when the first circulating pump 14*a* is brought to a halt, the first air trap 37*a* expands to the phantom-lined position shown in FIG. 9 to cause the air bubbles, then floating upwardly from the suction port 35, to be positively recovered in the first air trap 37*a*.

The second circulating pump 14*b* used in the heat absorbing cycle is, as shown in FIGS. 3 and 8, disposed at a level higher than the cooling heat exchanger 20 and the second heat exchanging portion 26*b* of the primary manifold 11. The air bubbles entering the heat absorbing cycle are collected in the vicinity of a suction port 40 of the second circulating pump 14*b* disposed at a high position as is the case with the heat radiating cycle, gathered at a center portion of a pump impeller within the second circulating pump 14*b* and the amount of the air bubbles being circulated in the heat absorbing cycle is consequently reduced. When the second circulating pump 14*b* is brought to a halt, the second air trap 37*b*, as is the case with the first air trap 37*a*, expands to the phantom-lined position as shown in FIG. 9 to allow the air bubble floating upwardly from the suction port 40 to be positively recovered by the second air trap 37*b*.

The first and second air traps 37*a* and 37*b* also serve to regulate the pressure inside the pipings used for the heat radiating and heat absorbing cycles, respectively. While increase in pressure inside the pipings may result in immediate leakage of liquid at points of connection of the pipings in the circulating passages, the first and second air traps 37*a* and 37*b* employed in the electric refrigerator of the type employing the thermoelectric module according to the present invention expand in response to the pressure inside the piping during the drive of the first and second circulating pumps 14*a* and 14*b* to thereby prevent the pressure inside the pipings from being increased.

Figure 10:
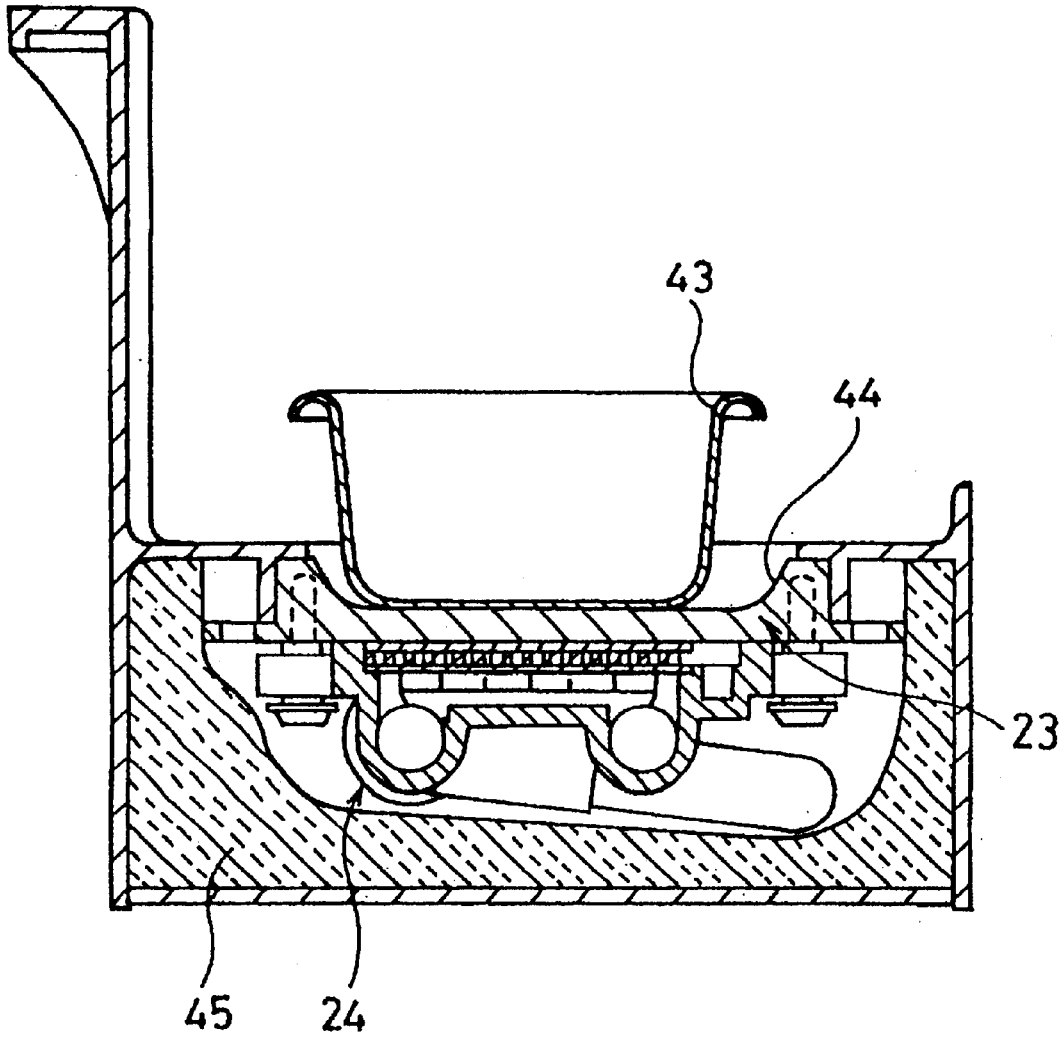
FIG. 10 is a longitudinal sectional view of an ice-making portion used in the electric refrigerator shown in FIG. 1.

Also, in the electric refrigerator of the type employing the thermoelectric module according to the present invention, since the auxiliary manifold 24 is employed in the indoor chamber 17 separate from the primary manifold 11 so that the radiating surface of the auxiliary manifold 24 can undergo a heat exchange with the liquid coolant in the heat absorbing cycle, the ice making plate 23 could be sufficiently cooled. FIG. 10 illustrates the details of the auxiliary manifold 24, the ice making plate 23 and their related component parts. The ice making plate 23 made of aluminum has an upper surface formed with a recess 44 for accommodating an ice box 43 and/or storing waste water which would be produced when the refrigerator is set in a defrosting mode of operation. Reference numeral 45 represents a heat insulating material.

In the electric refrigerator of the type employing the thermoelectric module according to the present invention, the following structure is employed to minimize condensed water.

Since the liquid coolant of +2° C. flows through the second circulating pump 14*b* for the heat absorbing cycle, condensation will occur if the second circulating pump 14*b* is disposed outside the indoor chamber. For this reason, the second circulating pump 14*b* is disposed inside the indoor chamber to eliminate condensation taking place on the surface of the second circulating pump 14*b*. Also, the fifth piping 32*e* connecting between the discharge port 38 of the second circulating pump 14*b* and the second heat exchanging portion 26*b* of the primary manifold 11 disposed outside the indoor chamber is so configured as to extend laterally downwardly of the cooling heat exchanger 20 within the machine chamber 19, then extend outwardly from the indoor chamber through the insulating material 8 at a location 46, as shown in FIGS. 1 and 3, in the vicinity of the primary manifold 11 and is finally connected with the second heat exchanging portion 26*b* of the primary manifold 11. In this way, most of the fifth piping 32*e* is disposed inside the indoor chamber, which is 5° C. in temperature, to thereby minimize occurrence of condensation of water.

(Embodiment 2)

Figure 11:
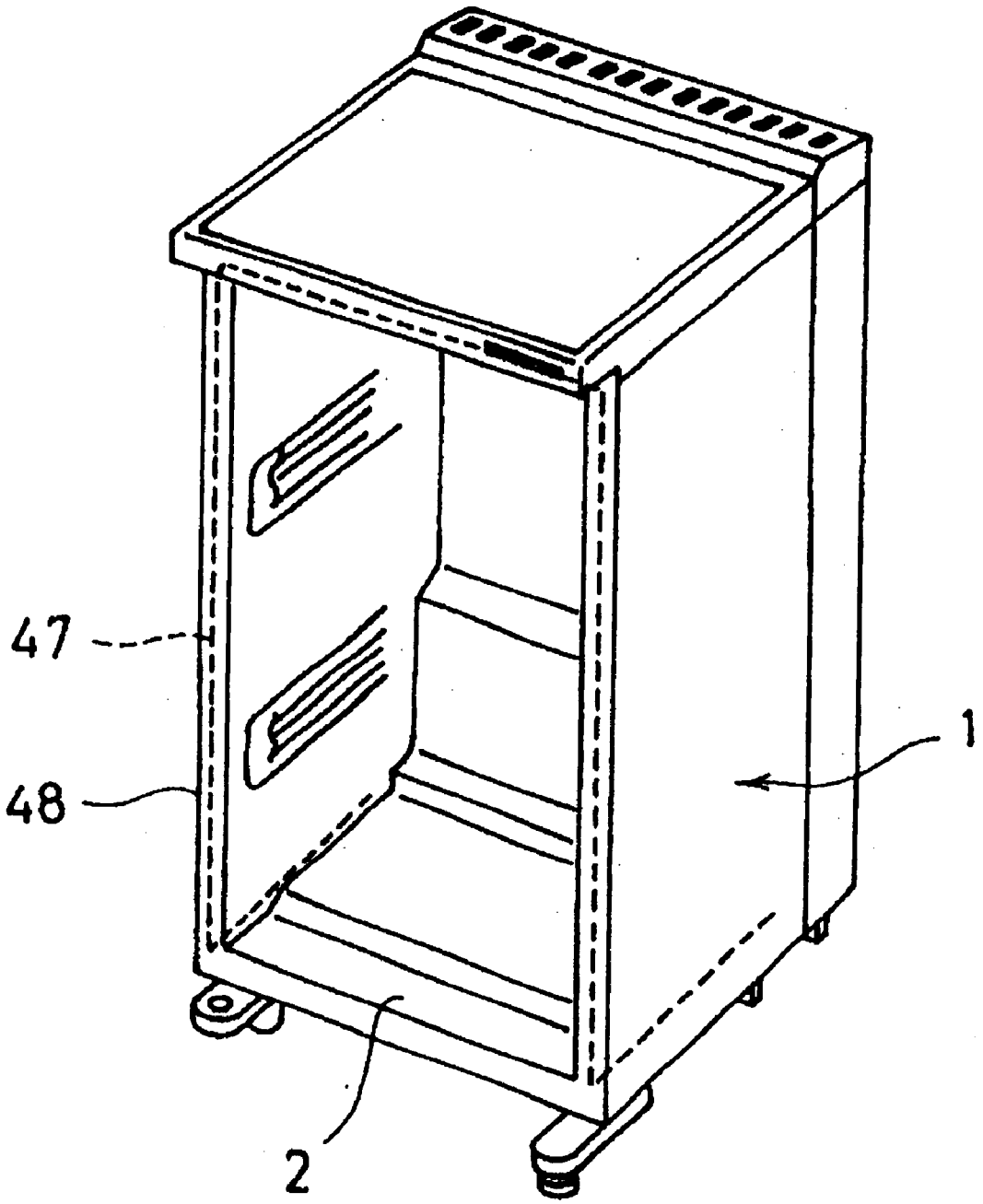
FIG. 11 is a perspective view, with a front door removed, of the electric refrigerator employing the thermoelectric refrigeration system according to a second preferred embodiment of the present invention.
Figure 12:
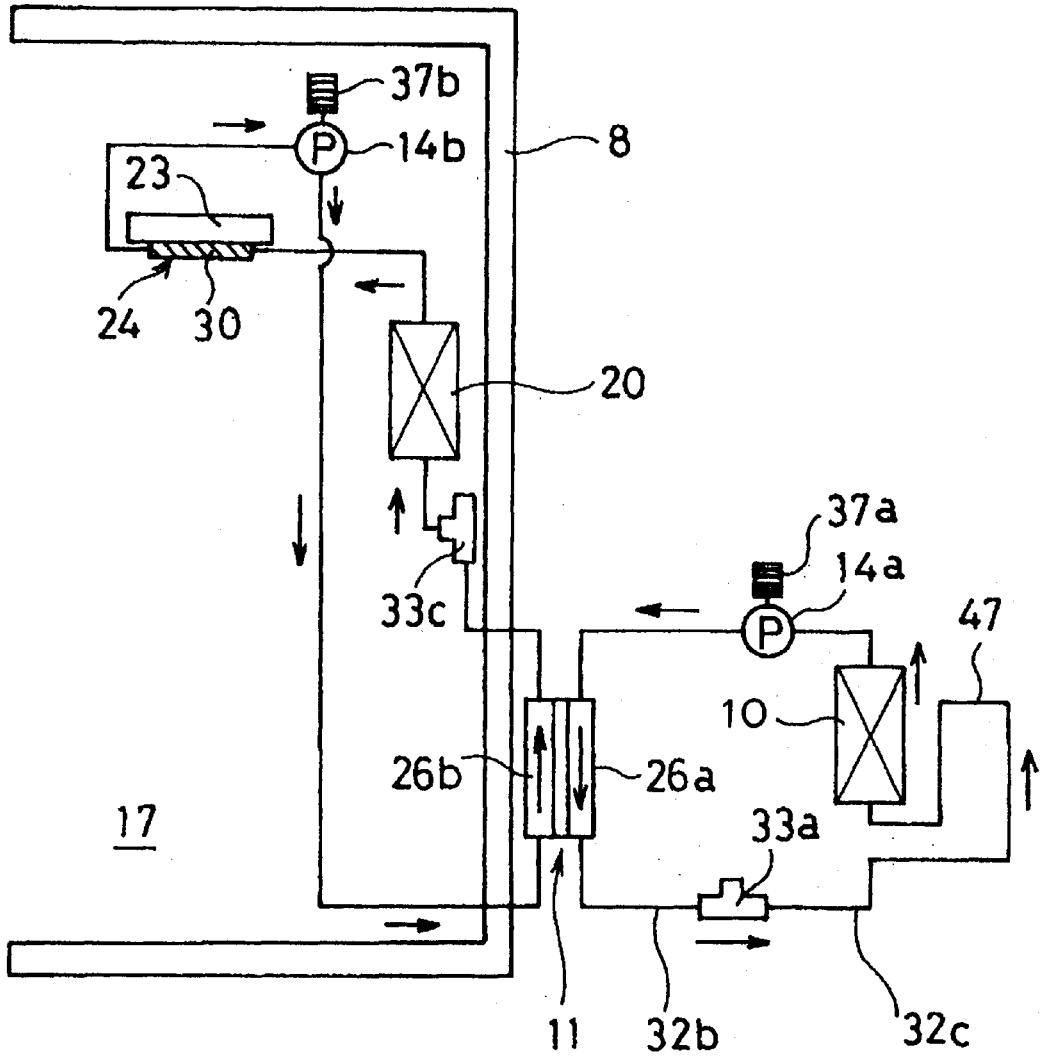
FIG. 12 is a schematic diagram showing the piping system for the heat radiating and heat absorbing cycles according to the second preferred embodiment of the present invention.

FIGS. 11 to 12 illustrate a second embodiment of the present invention. It is to be noted that like reference numerals are employed to denote like parts employed in the first embodiment of the present invention.

The second embodiment differs from the first embodiment in that a warm liquid coolant circulating in the heat radiating cycle in the first embodiment is utilized to avoid condensation of the refrigerator body.

More specifically, as shown in FIG. 12, a condensation preventive piping 47 is positioned on an upstream side with respect to and connected in series with the heat-radiating heat exchanger 10. FIG. 11 illustrates the electric refrigerator with the front door 4 removed and makes it clear that the condensation preventive piping 47 is disposed along a front wall 48 of the refrigerator to which the front door 4 abuts, to warm up the front wall 48 to minimize condensation. It is to be noted that the condensation preventive piping 47 is shown by the phantom lines in FIGS. 1 and 4.

Although in any one of the foregoing embodiments, the first and second air traps 37*a* and 37*b* have been disposed on respective sides adjacent the suction ports of the first and second circulating pumps 14*a* and 14*b*, similar effects can be obtained even if they are disposed on respective sides adjacent the discharge ports of the first and second circulating pumps 14*a* and 14*b*. In such case, a portion of the air bubbles gathering at the center portion of the pump impeller during the drive of the respective circulating pump can be pulverized into finely divided bubbles, and even though the finely divided air bubbles flow together with the liquid coolant, a portion of the finely divided air bubbles can be recovered by the first and second air traps 37*a* and 37*b*, disposed adjacent the respective discharge ports of the first and second circulating pumps 14*a* and 14*b* to minimize the circulating air bubbles to thereby improve the heat efficiency. Also, not only are the first and second air traps 37*a* and 37*b* disposed adjacent the respective suction or discharge ports of the first and second circulating pumps 14*a* and 14*b*, but it is more effective to employ the first and second air traps 37*a* and 37*b* adjacent the suction and discharge ports of the first and second circulating pumps 14*a* and 14*b*.

Although in any one of the foregoing embodiments the mixture of propylene glycol and water is used as the liquid coolant, a liquid coolant of any other composition can be employed and the use of different liquid coolants for the heat radiating and heat absorbing cycles, respectively, may bring about a further increase of the heat efficiency.

Although in the first embodiment the auxiliary manifold 24 is used to make ice, the liquid coolant flowing through the cooling heat exchanger of the heat absorbing cycle may be coupled directly with the suction port of the second circulating pump where the icing function is not required in the electric refrigerator employing the thermoelectric module.

Also, in the foregoing embodiments, the Peltier element as a thermoelectric module is employed in the electric refrigerator and the liquid coolant is allowed to flow through the first and second heat exchanging portions. However, the Peltier element can be equally employed in any thermoelectric refrigeration system other than the electric refrigerator and the liquid coolant may be allowed to flow through only one of the first and second heat exchanging portions.

Thus, according to the present invention, since the air trap is employed on the side of at least one of suction and discharge ports of each of the circulating pumps, the air bubbles flowing through the associated circulating passage can be recovered in the air trap to efficiently remove the air bubbles in the circulating passage.

Also, since each of the circulating pumps is disposed at a level higher than the heat radiating or heat absorbing heat exchanger and the first or second heat exchanging portion, the air bubbles mixed in the circulating passage can be gathered in the circulating pump so that the air bubbles flowing through the circulating passage can be reduced to improve the heat efficiency.

What is claimed is:

1. A thermoelectric refrigeration system comprising:

first and second thermoelectric modules each having a heat radiating surface and a cooling surface;

a primary manifold including a first heat exchanging portion thermally coupled with the heat radiating surface of the first thermoelectric module, and a second heat exchanging portion thermally coupled with the cooling surface of the first thermoelectric module;

an auxiliary manifold including a third heat exchanging portion thermally coupled with the heat radiating surface of the second thermoelectric module;

a heat radiating system comprising a first circulating passage which includes a first circulating pump having a discharge port and a suction port, a heat-radiating heat exchanger, the first heat exchanging portion of the primary manifold, and a liquid medium filled in the first circulating passage;

a heat absorbing system comprising a second circulating passage which includes a second circulating pump having a discharge port and a suction port, a cooling heat exchanger, the third heat exchanging portion of the auxiliary manifold, and a liquid medium filled in the second circulating passage; and an air trap coupled with at least one of the suction and discharge ports of any one of the first and second circulating pumps.

2. The thermoelectric refrigeration system as claimed in claim 1, wherein the first circulating pump is positioned at a level higher than the level where the heat-radiating heat exchanger and the first heat exchanging portion are disposed, and the second circulating pump is positioned at a level higher than the level where the cooling heat exchanger and the second heat exchanging portion are disposed.

3. The thermoelectric refrigeration system as claimed in claim 1, wherein the second circulating pump is positioned inside a refrigerator cabinet and the manifold is positioned outside the refrigerator cabinet and wherein a piping fluid-coupled at one end with the discharge port of the second circulating pump extends within the refrigerator cabinet with the opposite end thereof drawn outside the refrigerator cabinet at a location adjacent the manifold.

4. The thermoelectric refrigeration system as claimed in claim 1, wherein the liquid medium within the first heat exchanging portion and the liquid medium within the second heat exchanging portion flow in respective directions counter to each other.

5. The thermoelectric refrigeration system as claimed in claim 1, wherein pipes used in the circulating passages are employed in the form of a soft tube.

6. The thermoelectric refrigeration system as claimed in claim 1, wherein the liquid medium is employed in the form of a mixture of water and propylene glycol.

7. A thermoelectric refrigeration system comprising:

a thermoelectric module having a heat radiating surface and a cooling surface;

a manifold including a first heat exchanging portion thermally coupled with the heat radiating surface of the thermoelectric module, and a second heat exchanging portion thermally coupled with the cooling surface of the thermoelectric module;

a heat radiating system comprising a first circulating passage which includes a first circulating pump having a discharge port and a suction port, a heat-radiating heat exchanger, the first heat exchanging portion of the manifold, and a liquid medium filled in the first circulating passage;

a heat absorbing system comprising a second circulating passage which includes a second circulating pump having a discharge port and a suction port, a cooling heat exchanger, the second heat exchanging portion of the manifold, and a liquid medium filled in the second circulating passage; and an air trap coupled with at least one of the suction and discharge ports of any one of the first and second circulating pumps;

wherein the first circulating pump is positioned at a level higher than the level where the heat-radiating heat exchanger and the first heat exchanging portion are disposed, and the second circulating pump is positioned at a level higher than the level where the cooling heat exchanger and the second heat exchanging portion are disposed.

8. The thermoelectric refrigeration system as claimed in claim 7, wherein the second circulating pump is positioned inside a refrigerator cabinet and the manifold is positioned outside the refrigerator cabinet and wherein a piping fluid-coupled at one end with the discharge port of the second circulating pump extends within the refrigerator cabinet with the opposite end thereof drawn outside the refrigerator cabinet at a location adjacent the manifold.

9. The thermoelectric refrigeration system as claimed in claim 7, wherein the liquid medium within the first heat exchanging portion and the liquid medium within the second heat exchanging portion flow in respective directions counter to each other.

10. The thermoelectric refrigeration system as claimed in claim 7, wherein pipes used in the circulating passages are employed in the form of a soft tube.

11. The thermoelectric refrigeration system as claimed in claim 7, wherein the liquid medium is employed in the form of a mixture of water and propylene glycol.

12. A thermoelectric refrigeration system comprising:

a thermoelectric module having a heat radiating surface and a cooling surface;

a manifold including a first heat exchanging portion thermally coupled with the heat radiating surface of the thermoelectric module, and a second heat exchanging portion thermally coupled with the cooling surface of the thermoelectric module;

a heat radiating system comprising a first circulating passage which includes a first circulating pump having a discharge port and a suction port, a heat-radiating heat exchanger, a first heat exchanging portion of the manifold, and a liquid medium filled in the first circulating passage;

a heat absorbing system comprising a second circulating passage which includes a second circulating pump having a discharge port and a suction port, a cooling heat exchanger, the second heat exchanging portion of the manifold, and a liquid medium filled in the second circulating passage; and an air trap coupled with at least one of the suction and discharge ports of any one of the first and second circulating pumps;

wherein the second circulating pump is positioned inside a refrigerator cabinet and the manifold is positioned outside the refrigerator cabinet and wherein a piping fluid-coupled at one end with the discharge port of the second circulating pump extends within the refrigerator cabinet with the opposite end thereof drawn outside the refrigerator cabinet at a location adjacent the manifold.

13. The thermoelectric refrigeration system as claimed in claim 12, wherein the liquid medium within the first heat exchanging portion and the liquid medium within the second heat exchanging portion flow in respective directions counter to each other.

14. The thermoelectric refrigeration system as claimed in claim 12, wherein pipes used in the circulating passages are employed in the form of a soft tube.

15. The thermoelectric refrigeration system as claimed in claim 12, wherein the liquid medium is employed in the form of a mixture of water and propylene glycol.

16. A thermoelectric refrigeration system comprising:

a thermoelectric module having a heat radiating surface and a cooling surface;

a manifold including a first heat exchanging portion thermally coupled with the heat radiating surface of the thermoelectric module, and a second heat exchanging portion thermally coupled with the cooling surface of the thermoelectric module;

a heat radiating system comprising a first circulating passage which includes a first circulating pump having a discharge port and a suction port, a heat-radiating heat exchanger, a first heat exchanging portionofthe manifold, and a liquid medium filled in the first circulating passage;

a heat absorbing system comprising a second circulating passage which includes a second circulating pump having a discharge port and a suction port, a cooling heat exchanger, the second heat exchanging portion of the manifold, and a liquid medium filled in the second circulating passage; and an air trap coupled with at least one of the suction and discharge ports of any one of the first and second circulating pumps;

wherein the liquid medium within the first heat exchanging portion and the liquid medium within the second heat exchanging portion flow in respective directions counter to each other.

17. The thermoelectric refrigeration system as claimed in claim 16, wherein pipes used in the circulating passages are employed in the form of a soft tube.

18. The thermoelectric refrigeration system as claimed in claim 16, wherein the liquid medium is employed in the form of a mixture of water and propylene glycol.

19. A thermoelectric refrigeration system comprising:

a thermoelectric module having a heat radiating surface and a cooling surface;

a first heat exchanging portion thermally coupled with the heat radiating surface of the thermoelectric module;

a second heat exchanging portion thermally coupled with the cooling surface of the thermoelectric module;

a heat radiating system comprising a circulating passage which includes a circulating pump, a heat-radiating heat exchanger, the first heat exchanging portion, and a liquid medium filled in the circulating passage; and at least one air trap branched upwardly form the circulating passage so as to be positioned at a level higher than the circulating pump.

20. The thermoelectric refrigeration system as claimed in claim 19, wherein the circulating pump has a discharge port and a suction port, and said at least one air trap is coupled with at least one of the suction and discharge ports of the circulating pump.

21. The thermoelectric refrigeration system as claimed in claim 20, wherein the circulating pump is positioned at a level higher than the level where the heat-radiating heat exchanger and the first heat exchanging portion are disposed.

22. The thermoelectric refrigeration system as claimed in claim 20, wherein pipes used in the circulating passage are employed in the form of a soft tube.

23. The thermoelectric refrigeration system as claimed in claim 20, wherein the liquid medium is employed in the form of a mixture of water and propylene glycol.

24. A thermoelectric refrigeration system comprising:

a thermoelectric module having a heat radiating surface and a cooling surface;

a first heat exchanging portion thermally coupled with the heat radiating surface of the thermoelectric module;

a second heat exchanging portion thermally coupled with the cooling surface of the thermoelectric module;

a heat absorbing system comprising a circulating passage which includes a circulating pump, a cooling heat exchanger, the second heat exchanging portion, and a liquid medium filled in the circulating passage; and at least one air trap branched upwardly from the circulating passage so as to be positioned at a level higher than the circulating pump.

25. The thermoelectric refrigeration system as claimed in claim 24, wherein the circulating pump has a discharge port and a suction port, and said at least one air trap is coupled with at least one of the suction and discharge ports of the circulating pump.

26. The thermoelectric refrigeration system as claimed in claim 25, wherein the circulating pump is positioned at a level higher than the level where the cooling heat exchanger and the second heat exchanging portion are disposed.

27. The thermoelectric refrigeration system as claimed in claim 25, wherein pipes used in the circulating passage are employed in the form of a soft tube.

28. The thermoelectric refrigeration system as claimed in claim 25, wherein the liquid medium is employed in the form of a mixture of water and propylene glycol.

29. A thermoelectric refrigeration system comprising:

a thermoelectric module having a heat radiating surface and a cooling surface;

a manifold including a first heat exchanging portion thermally coupled with the heat radiating surface of the thermoelectric module, and a second heat exchanging portion thermally coupled with the cooling surface of the thermoelectric module;

a heat radiating system comprising a first circulating passage which includes a first circulating pump, a heat-radiating heat exchanger, the first heat exchanging portion of the manifold, and a liquid medium filled in the first circulating passage;

a heat absorbing system comprising a second circulating passage which includes a second circulating pump, a cooling heat exchanger, the second heat exchanging portion of the manifold, and a liquid medium filled in the second circulating passage; and at least one air trap branched upwardly from any one of the first and second circulating passages so as to be positioned at a level higher than a corresponding one of the first and second circulating pumps.

30. The thermoelectric refrigeration system as claimed in claim 29, wherein each of the first and second circulating pumps has a discharge port and a suction port, and said at least one air trap is coupled with at least one of the suction and discharge ports of any one of the first and second circulating pumps.

31. The thermoelectric refrigeration system as claimed in claim 30, wherein the first circulating pump is positioned at a level higher than the level where the heat-radiating heat exchanger and the first heat exchanging portion are disposed, and the second circulating pump is positioned at a level higher than the level where the cooling heat exchanger and the second heat exchanging portion are disposed.

32. The thermoelectric refrigeration system as claimed in claim 30, wherein pipes used in the first and second circulating passages are employed in the form of a soft tube.

33. The thermoelectric refrigeration system as claimed in claim 30, wherein the liquid medium is employed in the form of a mixture of water and propylene glycol.

* * * * *